US012704311B2

(12) United States Patent
Liu et al.

(10) Patent No.: US 12,704,311 B2
(45) Date of Patent: Aug. 11, 2026

(54) REFRIGERATOR

(71) Applicants: HEFEI HAIER REFRIGERATOR CO., LTD, Hefei (CN); QINGDAO HAIER REFRIGERATOR CO., LTD., Qingdao (CN); HAIER SMART HOME CO., LTD., Qingdao (CN)

(72) Inventors: Shanshan Liu, Qingdao (CN); Jianquan Chen, Qingdao (CN); Hui Liu, Qingdao (CN); Changzhi Wang, Qingdao (CN)

(73) Assignees: HEFEI HAIER REFRIGERATOR CO., LTD, Hefei (CN); QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 97 days.

(21) Appl. No.: 18/291,127

(22) PCT Filed: Jun. 24, 2022

(86) PCT No.: PCT/CN2022/101182

§ 371 (c)(1),
(2) Date: Jan. 22, 2024

(87) PCT Pub. No.: WO2023/000922

PCT Pub. Date: Jan. 26, 2023

(65) Prior Publication Data

US 2024/0328704 A1 Oct. 3, 2024

(30) Foreign Application Priority Data

Jul. 23, 2021 (CN) ..... 202121712468.5

(51) Int. Cl.
*F25D 23/00* (2006.01)
*F25D 11/02* (2006.01)

(52) U.S. Cl.
CPC ..... *F25D 23/006* (2013.01); *F25D 11/02* (2013.01)

(58) Field of Classification Search
CPC ..... F25D 23/003; F25D 23/006; F25D 11/02; F25D 2201/00
See application file for complete search history.

(56) References Cited

U.S. PATENT DOCUMENTS 3,866,431 A * 2/1975 Blomberg ..... F25D 11/027 62/333
6,550,255 B2 * 4/2003 Rudick ..... F25D 19/02 62/6
2010/0257886 A1 * 10/2010 Suzuki ..... F25D 17/067 62/276

FOREIGN PATENT DOCUMENTS

CA 2240362 A1 12/1998
CN 208817799 U 3/2019
(Continued)

*Primary Examiner* — Tavia Sullens
(74) *Attorney, Agent, or Firm* — MUNCY, GEISSLER, OLDS & LOWE, P.C.

(57) ABSTRACT

A refrigerator includes a top cover for the cooling chamber, an evaporator, a storage chamber and a cooling chamber located below the storage chamber, where at least a part of the top wall of the cooling chamber is formed on this top cover, and the evaporator is located inside the cooling chamber and fixedly connected to the top cover of the cooling chamber in a hanging manner. According to the refrigerator, by fixedly connecting the evaporator to the top cover of the cooling chamber in a hanging manner, the top cover is subjected to a downward force due to the gravity of the evaporator. This refrigerator avoids the bulging of the top cover upwards.

7 Claims, 5 Drawing Sheets

(56) References Cited

FOREIGN PATENT DOCUMENTS

| | | | | | |
|---|---|---|---|---|---|
| CN | 110285629 | A | | 9/2019 | |
| CN | 110375474 | A | * | 10/2019 | ..... F25D 19/00 |
| CN | 110375493 | A | | 10/2019 | |
| CN | 209893737 | U | | 1/2020 | |
| CN | 210036003 | U | | 2/2020 | |
| CN | 213040840 | U | | 4/2021 | |
| CN | 213040841 | U | | 4/2021 | |
| CN | 216114850 | U | | 3/2022 | |
| DE | 202017004727 | U1 | | 10/2017 | |
| JP | S6059066 | U | * | 4/1985 | |
| JP | 2004340420 | A | | 12/2004 | |
| JP | 2005257201 | A | | 9/2005 | |
| JP | 2015099459 | A | | 5/2015 | |
| JP | 2016169928 | A | * | 9/2016 | ..... F25D 23/028 |
| WO | WO-2020173360 | A1 | | 9/2020 | |

* cited by examiner

REFRIGERATOR

FIELD OF THE INVENTION

This present subject matter generally relates to a field of refrigeration equipment technology, specifically provides a refrigerator.

BACKGROUND OF THE INVENTION

In order to increase the vertical depth space of the storage compartment of a refrigerator, in the prior art, the cooling chamber of the refrigerator is generally arranged bellow the storage compartment, and the evaporator is fixed to the bottom wall of the cooling chamber.

Due to processing errors, alternation of cold and heat, etc., a top cover of the cooling chamber often bulges upwards during a long-term use of the refrigerator, and in serious cases even affects the sealing performance of the cooling chamber.

BRIEF DESCRIPTION OF THE INVENTION

In order to solve the above mentioned issues in the prior art, specifically to address the problem that the top cover of the cooling chamber bulging upwards during the use of a refrigerator, the present invention provides a new refrigerator.

One objective of the present invention is to hang the evaporator below the top cover of the cooling chamber. This arrangement ensures that the top cover is subjected to a downward force due to the gravity of the evaporator, so that the top cover does not bulge upwards.

In order to achieve the above object, the refrigerator of the present invention includes:

- a storage compartment and a cooling chamber located below the storage compartment;
- a top cover for the cooling chamber, where at least a part of the top wall of the cooling chamber is formed on this top cover;
- an evaporator, which is located inside the cooling chamber and fixedly connected to the top cover of the cooling chamber in a hanging manner.

Optionally, wherein the refrigerator further comprises an insulation component provided between the top cover of the cooling chamber and the evaporator, where the insulation component is fixedly connected to both the top cover and the evaporator, and the top surface of the insulation component abuts the top cover, and the bottom surface of the insulation component abuts the evaporator.

Optionally, wherein the bottom side of the top cover of the cooling chamber is provided with hook catches, the hook catches hook onto the circumferential edge of the insulation component to fix the insulation component to the bottom side of the top cover of the cooling chamber.

Optionally, wherein the bottom side of the top cover of the cooling chamber is also provided with positioning ribs, and the insulation component is provided with positioning grooves, the positioning ribs are embedded in the positioning grooves to prevent the insulation component from moving in the horizontal direction.

Optionally, wherein the evaporator has a fixed part, the fixed part is fixed to the insulation component by screws, bolts, or snap-fitting.

Optionally, wherein a distance between the fixed part and the hook catches in the horizontal direction is less than a preset distance.

Optionally, wherein the insulation component and the evaporator together enclose a frost retention space, with one end of the frost retention space facing the airflow having an opening.

Optionally, wherein the refrigerator further comprises a reflective film provided between the top cover of the cooling chamber and the insulation component.

Optionally, wherein the top cover of the cooling chamber comprises a horizontal part corresponding to the evaporator and an inclined part located at the rear side of the evaporator, the inclined part gradually inclines upwards in the direction away from the horizontal part; the refrigerator further comprises an insulation layer attached to the bottom side of the inclined part.

Optionally, wherein the refrigerator further comprises an evaporator bottom plate fixed to the bottom side of the evaporator, and the evaporator bottom plate is provided with a drainage grille; and/or the refrigerator further comprises a defrosting device provided on the evaporator.

Based on the above description, those person skilled in the art will understand that in the technical solution of the present invention, by fixedly connecting the evaporator to the top cover of the cooling chamber in a hanging manner, the top cover is subjected to a downward force due to the gravity of the evaporator. This design avoids the bulging of the top cover upwards.

Furthermore, by providing an insulation component between the top cover of the cooling chamber and the evaporator, and fixedly connecting the insulation component to both the top cover and the evaporator, the present invention also prevents the direct transfer of cold from the evaporator to the storage compartment through the top cover, which could not result in excessively low temperature in the storage compartment.

Moreover, by providing hook catches on the bottom side of the top cover of the cooling chamber, the top cover in enabled to hook onto the edge of the insulation component, thereby facilitating the installation of the top cover and the insulation component.

A detailed description of specific embodiments of the present invention, in conjunction with the accompanying drawings, will make the above mentioned and other objectives, advantages, and features of the present invention more apparent to those person skilled in the art.

BRIEF DESCRIPTION OF THE DRAWINGS

In order to clarify the technical solutions of the present invention, some embodiments will be described with reference to the accompanying drawings. It should be understood that the same reference signs denote the same or similar parts in different drawings; the drawings of the present invention are not necessarily drawn to scale. In the drawings.

DETAILED DESCRIPTION

Figure 1:
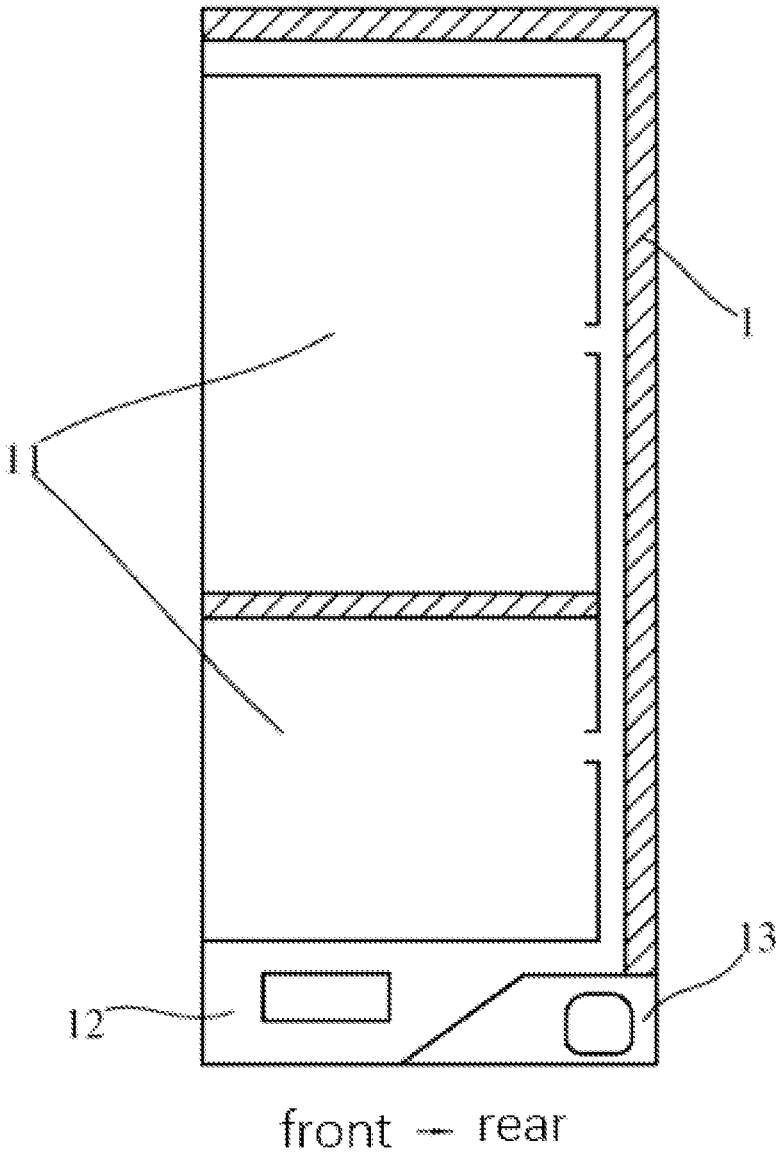
FIG. 1 is a schematic diagram of the compartment distribution of a refrigerator in some embodiments of the present invention.

Those persons skilled in the field should understand that the embodiments described below are just a part of the embodiments of the present invention and not all the embodiments of the invention. These embodiments aim to explain the technical principles of the present invention and are not intended to limit the scope of protection of the present invention. Based on the embodiments provided by the present invention, all other embodiments obtained by ordinary technicians in this field without creative labor should still fall within the protection scope of the present invention.

It should be noted that in the description of the present invention, terms indicating direction or positional relationships such as "center," "up," "down," "top," "bottom," "left," "right," "vertical," "horizontal," "inner," "outer," etc., are based on the directions or positional relationships shown in the drawings. These are merely for the convenience of description and do not indicate or imply that the described devices or elements must have a specific orientation, be constructed and operated in a specific orientation, and therefore should not be considered as limiting the invention. Moreover, terms like "first," "second," "third," etc., are used only for descriptive purposes and should not be construed as indicating or implying relative importance.

Furthermore, it should be explained that in the description of the present invention, unless otherwise explicitly specified and limited, terms such as "installation," "connection," "link" should be understood in a broad sense. For example, they can be fixed connections, detachable connections, or integrally connected; mechanical connections, electrical connections; direct connections or indirect connections through intermediaries, and internal communication between two elements. Those skilled in the art can understand the specific meanings of these terms in the present invention according to the actual situation.

Further, it should be noted that the refrigerator of the present invention is a air-cooled refrigerator (frost-free refrigerator.

FIG. 1 shows the compartment distribution of the refrigerator in some embodiments of the present invention.

In some embodiments, the refrigerator comprises a cabinet body 1 having a storage compartment 11, a cooling chamber 12, and a compressor compartment 13. The storage compartment 11, located above the cooling chamber 12, is used for storing items such as food ingredients, beverages, medicines, etc. Further, those person skilled in the art can set any feasible number of storage compartments 11 according to actual needs and set up various storage compartments in the cabinet body 1 according to the storage requirements of the stored items, including freezer compartments, refrigeration compartments, and/or variable temperature compartments.

Further, the cooling chamber 12 is used to arrange the evaporator. The compressor compartment 13 is used to arrange the compressor, condenser, water collection tray, etc.

FIGS. 2 to 8 show the top cover of the cooling chamber, the evaporator, and their related structures in some embodiments of the present invention.

Figure 2:
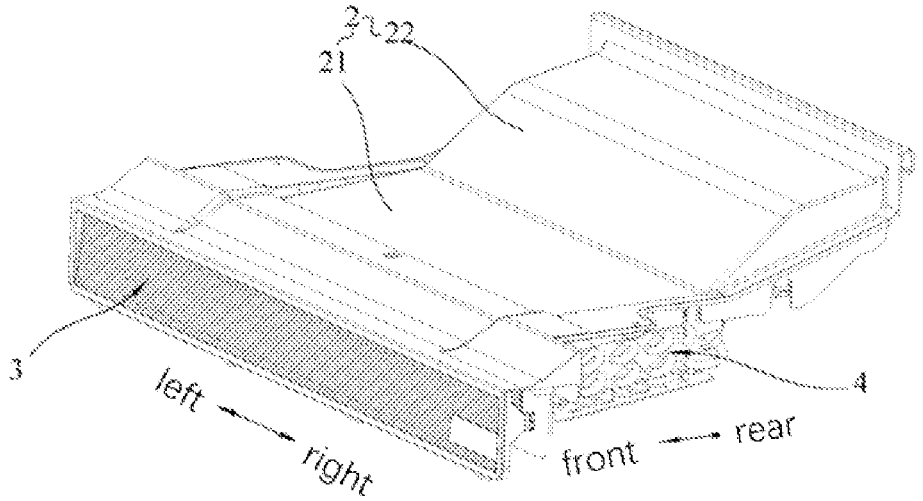
FIG. 2 is a schematic diagram showing the assembly effect of the top cover of the cooling chamber, the evaporator, and their related structures in some embodiments of the present invention.
Figure 3:
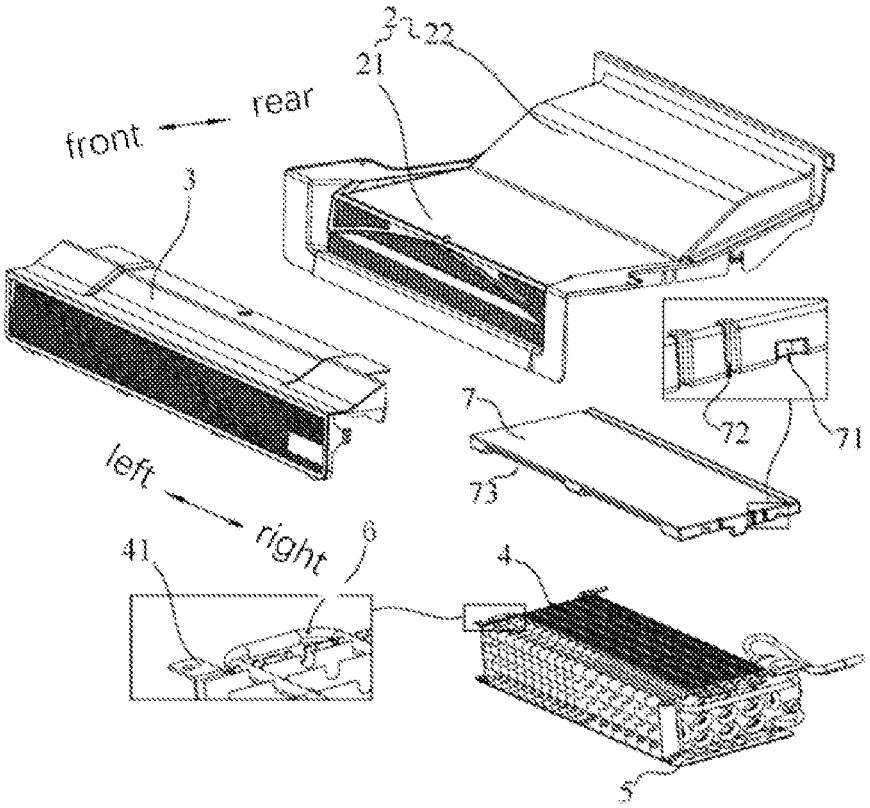
FIG. 3 is an exploded view of the structure shown in FIG. 2.
Figure 4:
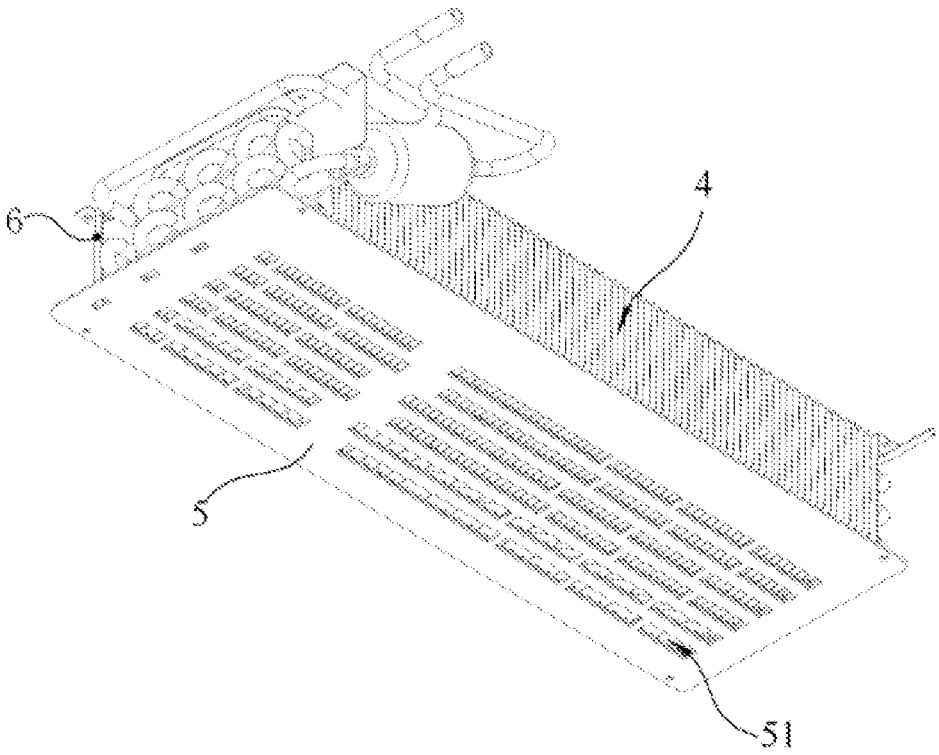
FIG. 4 is an isometric view of the evaporator and its related structures in some embodiments of the present invention.

As shown in FIGS. 2 to 4, the refrigerator of the present invention further comprises a top cover 2 of the cooling chamber, a return air cover 3, an evaporator 4, an evaporator bottom plate 5, a defrosting device 6, and an insulation component 7.

The top cover 2 of the cooling chamber is placed above the cooling chamber 12 to form at least a part of the top wall of the cooling chamber 12 on the top cover 2. Referring to FIGS. 2 and 3, it can be seen that the front end of the top cover 2 of the cooling chamber also has a downwardly extending front side plate (not marked in the figure), which forms at least a part of the front side wall of the cooling chamber 12. Further, a ventilation lattice (not marked in the figure) is set on this front side plate to allow air to enter the cooling chamber 12 from this ventilation lattice.

As shown in FIGS. 2 and 3, the return air cover 3 is set on the front side of the top cover 2 of the cooling chamber and covers the front side plate of the top cover 2 of the cooling chamber. Further, the return air cover 3 and the top cover 2 of the cooling chamber can be fixed together in any feasible way, such as screw connection, snap-fitting, interference fit, etc.

As shown in FIGS. 3 and 4, the evaporator 4, the evaporator bottom plate 5, and the defrosting device 6 are fixedly connected together. Specifically, the evaporator bottom plate 5 is set on the bottom side of the evaporator 4 and fixedly connected to the evaporator 4 by screws or bolts. The defrosting device 6 is a pipeline wrapped on, adhered to, or embedded in the evaporator 4 and allows refrigerant to flow through. Optionally, the evaporator 4 is a finned evaporator, and the fins of the evaporator 4 are provided with grooves into which the defrosting device 6 is embedded.

The evaporator bottom plate 5 is provided with a drainage grille 51 for draining water. The condensation water and defrost water on the evaporator 4 fall through this grille 51 onto the bottom wall of the cooling chamber 12, and then flow to the water collection tray in the compressor compartment 13 through the leak hole in the bottom wall of the cooling chamber 12 and the water guide pipe sealingly connected to this leak hole.

The defrosting device 6 is connected in series with the refrigerator compressor to receive high-temperature refrigerant flowing out of the compressor, thereby heating the evaporator 4 with this high-temperature refrigerant to melt the frost on the evaporator 4.

Moreover, those skilled in the art can also set the defrosting device 5 as an electric heating device wrapped on, adhered to, or embedded in the evaporator 4 according to the need. The electric heating device heats the evaporator 4 when it is powered to melt the frost on the evaporator 4.

As shown in FIGS. 2 and 3, the top cover 2 of the cooling chamber comprises a horizontal part 21 corresponding to the evaporator 4 and an inclined part 22 located at the rear side of the evaporator 4. The inclined part 22 gradually inclines upwards in the direction away from the horizontal part 21. Although not shown in the figure, a fan is provided below the inclined part 22, which is used to drive air to circulate between the storage compartment 11 and the cooling chamber 12.

As shown in FIGS. 5 to 8, the insulation component 7 is a plate-like structure, which is set between the top cover 2 of the cooling chamber and the evaporator 4. The insulation component 7 is fixedly connected to both the top cover 2 of the cooling chamber and the evaporator 4, and the top surface of the insulation component 7 abuts the top cover 2 of the cooling chamber, and the bottom surface of the insulation component 7 abuts the evaporator 4.

In the present invention, the insulation component 7 can be a component made of any feasible insulation material, such as metal thermal insulation material, ceramic thermal insulation material, organic insulation material, etc. Moreover, the insulation component 7 can be a structure made of a single material, or a structure composed of a variety of materials, or a structure composed of multiple components fixed together.

Figure 5:
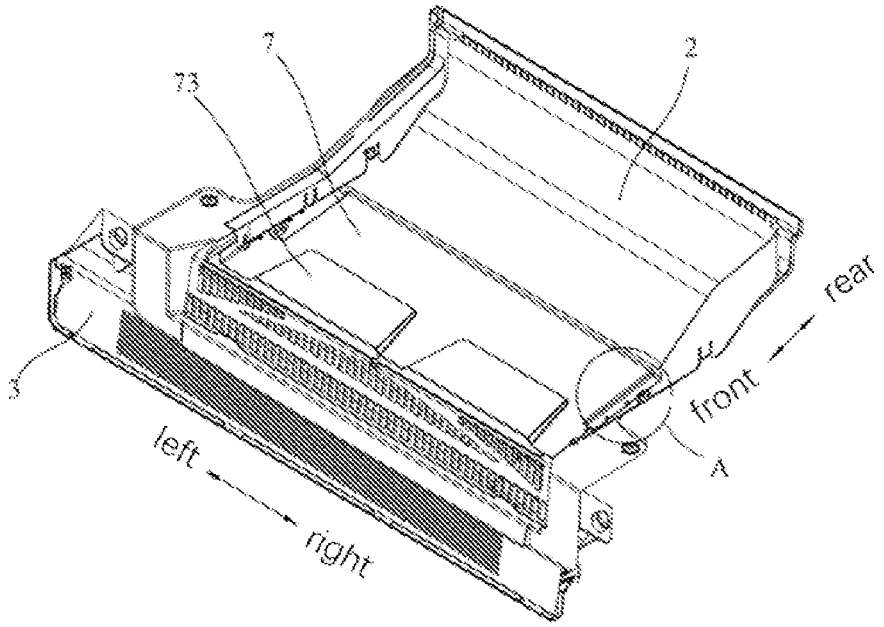
FIG. 5 is an isometric view of the top cover of the cooling chamber and its related structures in some embodiments of the present invention.
Figure 6:
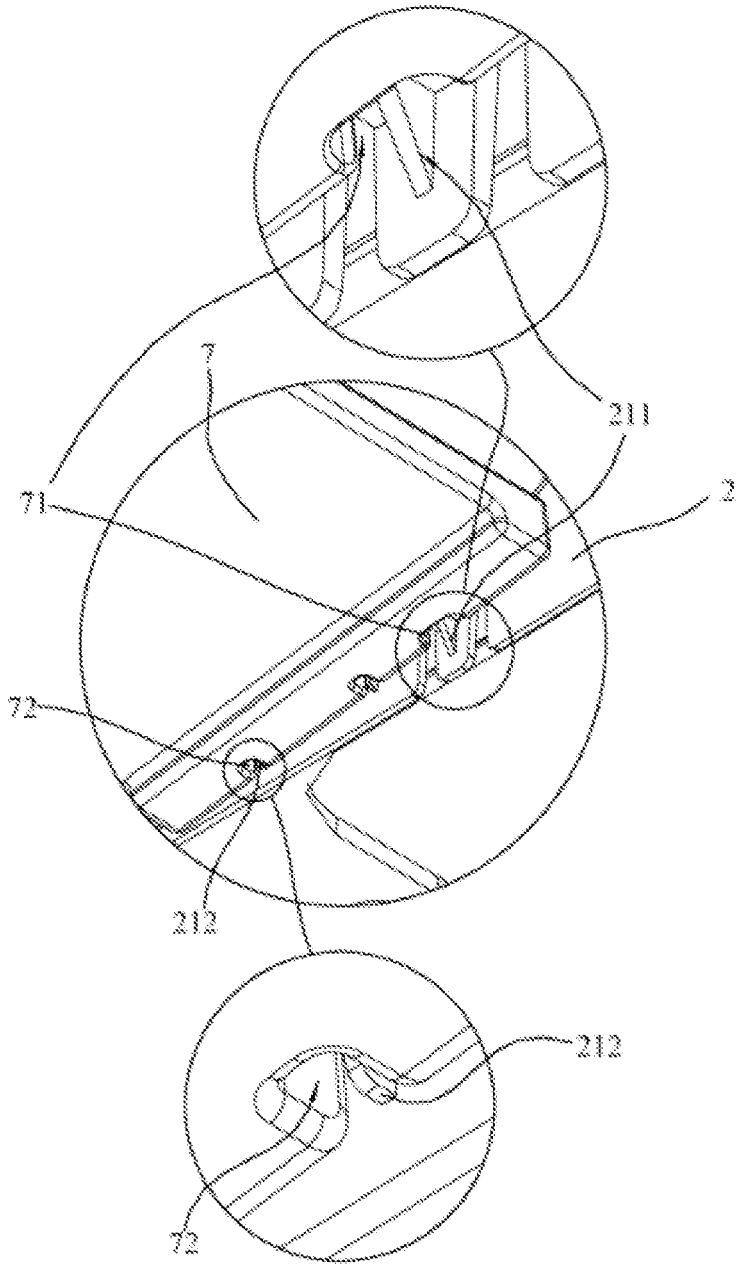
FIG. 6 is an enlarged view of part A in FIG. 5.
Figure 7:
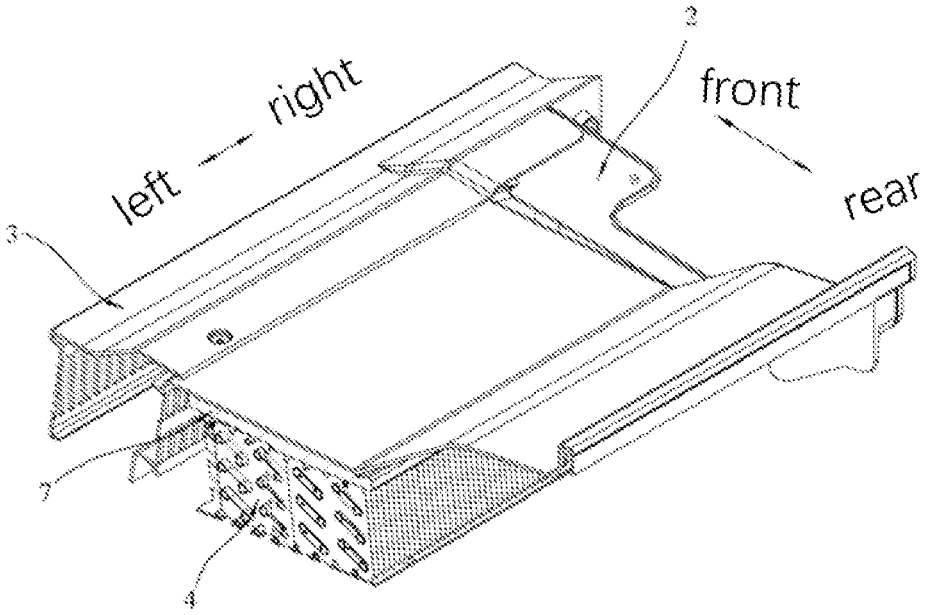
FIG. 7 is a sectional view of the structure shown in FIG. 2.

As shown in FIGS. 3, 5, and 6, the bottom side (specifically the bottom side of the horizontal part 21) of the top cover 2 of the cooling chamber is provided with hook catches 211 and positioning ribs 212. The insulation component 7 is provided with card slots 71 corresponding to the hook catches 211 and positioning slots 72 corresponding to the positioning ribs 212. Preferably, both the card slots 71 and the positioning slots 72 are set at the circumferential edge of the insulation component 7.

Continuing to refer to FIGS. 5 and 6, in the assembled state, the hook catches 211 are embedded in the card slots 71 and abut the top wall of the card slots 71, thereby suspending the insulation component 7 below the top cover 2 of the cooling chamber. Preferably, the insulation component 7 abuts the bottom surface of the top cover 2 of the cooling chamber. The positioning ribs 212 are embedded in the positioning slots 72 to restrict the horizontal movement of the insulation component 7.

Referring to FIG. 5, it can be seen that the left and right sides of the top cover 2 of the cooling chamber are respectively provided with hook catches 211 and positioning ribs 212, and the left and right sides of the insulation component 7 are respectively provided with card slots 71 and positioning slots 72, so that the top cover 2 of the cooling chamber and the insulation component 7 are completely fixed together by the hook catches 211 and positioning ribs 212, card slots 71, and positioning slots 72 on both sides.

Moreover, under the premise that the top cover 2 of the cooling chamber and the insulation component 7 can be completely fixed together, those skilled in the art can also omit the setting of the card slot 71 on the insulation component 7 according to the need and make the hook catch 211 hook the bottom surface of the insulation component 7.

Or, under the premise that the top cover 2 of the cooling chamber and the insulation component 7 can be completely fixed together, those skilled in the art can also omit the setting of the positioning rib 212 and the positioning slot 72 according to the need.

Returning to FIG. 3, the evaporator 4 has a fixed part 41, which is fixed to the insulation component 7 by screws or bolts. Specifically, the fixed part 41 comprises through holes allowing screws or bolts to pass through, and the insulation component 7 also comprises threaded holes. The threaded section of the screws or bolts passes through the through holes of the fixed part 41 and tightens with the threaded holes, thereby fixing the evaporator 4 to the insulation component 7.

Additionally, skilled practitioners in the field can also use any other feasible method to fix the evaporator 4 and insulation component 7 together, such as snap-fitting.

Furthermore, the distance between the fixed part 41 and the hook catches 211 in the horizontal direction is less than a preset distance, bringing the fixed part 41 and the hook catches 211 sufficiently close to each other. This prevents the insulation component 7 from deforming due to the large torque when the fixed part 41 and the hook catches 211 are far apart, thereby enhancing the reliability of the insulation component 7. The preset distance is a parameter obtained through multiple tests, and its value depends on the material, thickness, and other parameters of the insulation component 7. This preset distance can be any feasible value, such as 1 cm, 2 cm, 5 cm, etc.

In other embodiments of the present invention, practitioners can also directly fix the evaporator 4 to the top cover 2 of the cooling chamber as required. For example, a fixed column with threaded holes can be provided below the top cover 2 of the cooling chamber. The screws or bolts pass through the through holes of the fixed part 41 and then tighten with the fixed column, thereby fixing the evaporator 4 to the top cover 2 of the cooling chamber. Consequently, the insulation component 7 is clamped between the evaporator 4 and the top cover 2 of the cooling chamber. Alternatively, practitioners can omit the insulation component 7 as required, allowing the evaporator 4 to abut the top cover 2 of the cooling chamber and setting an insulation layer on the top side of the top cover 2.

Figure 8:
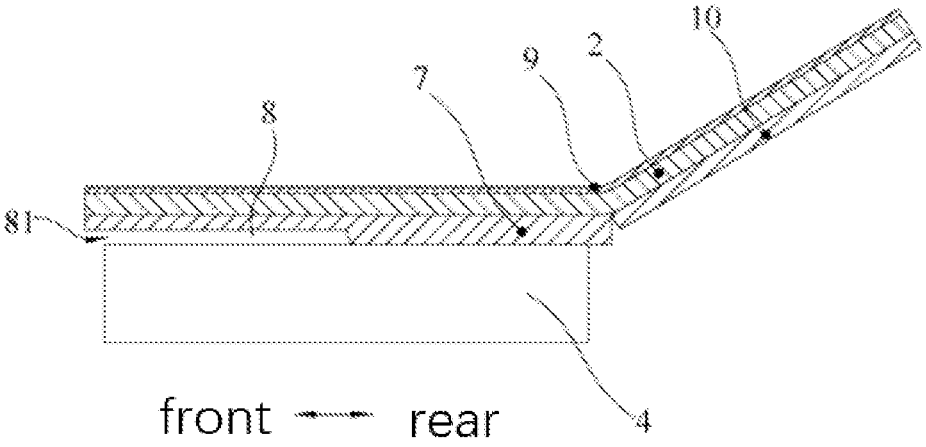
FIG. 8 is a schematic diagram illustrating the construction principle of the top cover of the cooling chamber, the evaporator, and their related structures in some embodiments of the present invention.

As shown in FIGS. 3, 5, and 8, the side of the insulation component 7 facing the evaporator 4 forms a recessed groove 73 with an opening. After the insulation component 7 and the evaporator 4 are fitted together, the top wall, side wall of the recessed groove 73, and the top surface of the evaporator 4 together enclose the frost retention space 8, while the opening of the recessed groove 73 forms the opening 81 of the frost retention space 8.

It is easy to see from the figures that the opening 81 is formed at one end of the frost retention space 8 facing the airflow, allowing airflow to enter the frost retention space 8 through the opening 81, and then pass through the ventilation gap on the evaporator 4, thereby being cooled by the evaporator 4.

Preferably, the height of the frost retention space 8 is greater than the maximum height of the frost on the evaporator 4 to prevent the frost from obstructing air movement when it abuts the top wall (insulation component 7) of the frost retention space 8.

As shown in FIG. 8, in some embodiments of the present invention, the refrigerator further comprises a reflective film 9 provided between the top cover 2 of the cooling chamber and the insulation component 7. This reflective film 9 is used to hinder the transfer of heat from the storage compartment 11 to the cooling chamber 12. The reflective film 9 can be attached to the bottom surface of the top cover 2 of the cooling chamber or the top surface of the insulation component 7. Additionally, practitioners can also set the reflective film 9 between the insulation component 7 and the evaporator 4 as required. Preferably, the reflective film 9 is aluminum foil.

Continuing with FIG. 8, in some embodiments of the present invention, the refrigerator further comprises an insulation layer 10 attached to the bottom side of the inclined part 22. This insulation layer 10 is used to prevent condensation or icing on the bottom surface of the inclined part 22. The insulation layer 10 can be made of any feasible material, such as PE cotton (polyethylene cross-linked, also known as cross-linked foam cotton), polyurethane foam, polystyrene board, etc.

Based on the foregoing description, those skilled in the art can understand that the present invention suspends the evaporator 4 beneath the top cover 2 of the cooling chamber through the insulation component 7, causing the top cover 2 of the cooling chamber to have a downward force due to the weight of the evaporator 4. This prevents the top cover 2 of the cooling chamber from bulging upwards. At the same time, it avoids setting a separate top cover for the evaporator 4, reducing the production and manufacturing costs of the refrigerator.

Furthermore, by providing hook catches 211 on the bottom side of the top cover 2 of the cooling chamber, the top cover 2 can hook onto the edge of the insulation component 7, facilitating the installation of the top cover 2 and the insulation component 7. Specifically, workers can first fix the insulation component 7 and the evaporator 4 together, then align the top cover 2 of the cooling chamber with the insulation component 7 and press down the top cover 2 to fix them together.

In conclusion, the technical solution of the present invention has been described in conjunction with multiple embodiments in the foregoing. However, it is easy for those skilled in the art to understand that the protection scope of the present invention is not limited to these specific embodiments. Any changes, equivalent substitutions, improvements, etc., made within the technical concept and/or technical principles of the present invention fall within the protection scope of the present invention.

What is claimed is:

1. A refrigerator, comprising a storage compartment and a cooling chamber located below the storage compartment;

a top cover for the cooling chamber, where at least a part of a top wall of the cooling chamber is formed on the top cover;

an evaporator, which is located inside the cooling chamber and fixedly connected to the top cover of the cooling chamber in a hanging manner; and an insulation component provided between the top cover of the cooling chamber and the evaporator, where the insulation component is fixedly connected to both the top cover and the evaporator, and a top surface of the insulation component abuts the top cover, and a bottom surface of the insulation component abuts the evaporator; and wherein the insulation component and the evaporator together enclose a frost retention space, with one end of the frost retention space facing an airflow having an opening;

wherein a bottom side of the top cover of the cooling chamber is provided with hook catches, the hook catches hook onto a circumferential edge of the insulation component to fix the insulation component to the bottom side of the top cover of the cooling chamber;

wherein the bottom side of the top cover of the cooling chamber is also provided with positioning ribs, and the insulation component is provided with positioning grooves, the positioning ribs are embedded in the positioning grooves to prevent the insulation component from moving in a horizontal direction;

wherein the evaporator has a fixed part, the fixed part is fixed to the insulation component by screws, bolts, or snap-fitting.

2. The refrigerator of claim 1, wherein a distance between the fixed part and the hook catches in the horizontal direction is less than a preset distance.

3. The refrigerator of claim 1, wherein the refrigerator further comprises a reflective film provided between the top cover of the cooling chamber and the insulation component.

4. The refrigerator of claim 1, wherein the top cover of the cooling chamber comprises a horizontal part corresponding to the evaporator and an inclined part located at a rear side of the evaporator, the inclined part gradually inclines upwards in a direction away from the horizontal part;

the refrigerator further comprises an insulation layer attached to a bottom side of the inclined part.

5. The refrigerator of claim 1, wherein the refrigerator further comprises an evaporator bottom plate fixed to a bottom side of the evaporator, and the evaporator bottom plate is provided with a drainage grille; and/or the refrigerator further comprises a defrosting device provided on the evaporator.

6. The refrigerator of claim 1, wherein the side of the insulation component facing the evaporator forms a recessed groove with an opening; a top wall of the recessed groove, a side wall of the recessed groove and a top surface of the evaporator together enclose the frost retention space, while the opening of the recessed groove forms the opening of the frost retention space.

7. The refrigerator of claim 1, wherein a height of the frost retention space is greater than a maximum height of a frost on the evaporator.

* * * * *